US009688939B1

(12) United States Patent
Schwaebisch et al.

(10) Patent No.: US 9,688,939 B1
(45) Date of Patent: Jun. 27, 2017

(54) METAL DETERGENTS

(71) Applicant: Infineum International Limited, Abingdon (GB)

(72) Inventors: Dirk Schwaebisch, Oxford (GB); Jamie Musmacher, Jersey City, NJ (US); Alastair A. Cant, Didcot (GB)

( * ) Notice: Subject to any disclaimer, the term of this patent is extended or adjusted under 35 U.S.C. 154(b) by 0 days.

(21) Appl. No.: 15/006,219

(22) Filed: Jan. 26, 2016

(51) Int. Cl.

| | |
|---|---|
| ***C10M 135/02*** | (2006.01) |
| ***C10M 159/22*** | (2006.01) |
| ***C10M 135/06*** | (2006.01) |
| ***C07C 319/28*** | (2006.01) |
| ***C07C 323/20*** | (2006.01) |

(52) U.S. Cl.
CPC ..... *C10M 135/06* (2013.01); *C07C 319/28* (2013.01); *C07C 323/20* (2013.01)

(58) Field of Classification Search
None
See application file for complete search history.

(56) References Cited

U.S. PATENT DOCUMENTS

| | | | | |
|---|---|---|---|---|
| 4,971,710 | A * | 11/1990 | Liston | C07G 17/008 508/574 |
| 8,772,209 | B2 | 7/2014 | Mahieux et al. | |
| 2014/0130757 | A1 * | 5/2014 | Marsh | C10M 159/22 123/1 A |

FOREIGN PATENT DOCUMENTS

| | | | |
|---|---|---|---|
| EP | 2682451 | A1 | 1/2014 |
| WO | WO-2015153160 | A1 | 10/2015 |

OTHER PUBLICATIONS

American Petroleum Institute, Engine Oil Licensing and Certification System, Industry Services Dept., Fourteenth Edition, Dec. 1996, Addendum 1, Dec. 1998.

* cited by examiner

*Primary Examiner* — Vishal Vasisth

(57) ABSTRACT

Sulfurized calcium phenate detergents having a reduced unsulfurized alkyl-substituted phenol content are made by:

(A) providing, made from an unsulfurized alkyl-substituted phenol, a sulfurized calcium phenate detergent that, optionally, may have been further reacted with carbon dioxide;

(B) adding to the detergent from 1 to 100 mass %, based on the mass of the detergent, of an organic solvent that has a boiling point of above 100° C. and below the boiling point of the unsulfurized alkyl-substituted phenol; and (C) removing the organic solvent from the detergent thereby to reduce the unsulfurized alkyl-substituted phenol content.

13 Claims, No Drawings

METAL DETERGENTS

FIELD OF THE INVENTION

This invention relates to a process for preparing sulfurized calcium phenate detergents having a reduced phenol content.

BACKGROUND OF THE INVENTION

Sulfurized calcium alkyl phenate detergents are well-known additive components for internal combustion engine lubricating oil compositions (or lubricants). Unreacted alkylphenol used in their manufacture may be present in the detergents. Such alkylphenols have undesirable properties such as giving rise to corrosion, and certain alkylphenols (e.g. nonylphenol and tetrapropenylphenol) are classified as reproductive toxins.

The art describes ways of overcoming this problem, a recent example being U.S. Pat. No. 8,772,209 B2 ('209), which describes protonating a phenate detergent with an acidic compound followed by removing unreacted phenol and protonated unsulfurized salt such as by distillation. A problem with this approach is that acid salts (e.g. Ca stearate) that are formed are neutralised to release organic acid into the lubricant, such acid being detrimental to the engine.

WO 2015/153160 A1 ('160) describes preparing an overbased sulfurized alkaline earth metal alkylphenate composition in oil. The composition is heated and subjected to steam stripping followed by filtration. The resulting product is stated to exhibit an improved rate and efficiency of filtration, but further states, without exemplification, that the product may also have a reduced level of free monomeric alkylphenate or alkylphenol (e.g. tetrapropenyl phenol (TPP)) than materials prepared by conventional means without the steam-stripping step. WO 2015/153160 A1 makes no mention of solvent addition to the resulting product before carrying out the stripping step.

SUMMARY OF THE INVENTION

This invention meets the problem of '209 by adding to the detergent defined proportions of a solvent having a lower boiling point than the phenol as an aid to distillation of the phenol from the detergent without generating species detrimental to the engine.

Thus, in a first aspect, the invention provides a process for preparing sulfurized calcium phenate detergent having a reduced content of unsulfurized alkyl-substituted phenol comprising the steps of:

(A) providing, made from an unsulfurized alkyl-substituted phenol, a sulfurized calcium phenate detergent that, optionally, may have been further reacted with carbon dioxide;

(B) adding to the detergent from 1 to 100, such as 5 to 40, such as 5 to 30, mass %, based on the mass of the detergent, of an organic solvent that has a boiling point of above 100° C. and below the boiling point of the unsulfurized alkyl-substituted phenol; and (C) distilling the organic solvent from the detergent thereby to reduce the content of the unsulfurized alkyl-substituted phenol.

In a second aspect, the invention provides a detergent obtained or obtainable by the process of the above first aspect.

In a third aspect, the invention provides a lubricating oil composition comprising an oil of lubricating viscosity in a major amount and a detergent of the second aspect of the invention in a minor amount.

The examples of the invention below demonstrate the surprising advantages thereof.

Definitions

In this specification, the following words and expressions, if and when used, have the meanings ascribed below:

"Active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more of a composition;

"minor amount" means less than 50 mass % of a composition;

"TBN" means total base number as measured by ASTM D2896.

Furthermore in this specification, if and when used:

"calcium content" is as measured by ASTM D4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to one or more aspects of the invention, will now be discussed in more detail below.

Step (A)

As examples of the phenate additives, there may be mentioned those of TBN in the range of 50-400. The alkyl groups may be those having 9-100, preferably 9-70, most preferably 9-50, carbon atoms.

As examples of alkylphenol starting materials, there may be mentioned those prepared via the alkylation of phenol with propylene-based alkenes; these may be characterized by branched-chain para-alkyl substitution where attachment of the chain to the benzene ring is via C-2 or C-3 carbon atoms. A notable example is tetrapropenylphenol ("TPP").

The art describes preparation of phenate detergents from phenols. The phenates of this invention may, optionally, have been carbonated by reaction with carbon dioxide to give rise to overbased phenates. Specific examples are given in the EXAMPLES section of this specification.

Step (B)

Examples of organic solvents that may be used include alkanols and aromatic hydrocarbons. Isodecanol is preferred: it has a boiling point of 220° C., cf 313° C. for TPP. It should be noted that the Ca phenate starting material may contain small amounts of organic solvent; amounts given in this specification are those added as in step (B).

Step (C)

All or most of the organic solvent is removed in step (C). Preferably, after step (B) and before step (C), a base oil is added; this cuts back the phenate before distillation rather than after and appears to give rise to a viscosity benefit.

Steps (B) and (C) may be carried out in a sequence of repeated steps, or carried out in single steps (one step (B) followed by one step (C) so that each of steps (B) and (C) is carried out once only).

If further reduction of the phenol content is required, phenolic functional groups in the product in the product of step (C) may be oxyalkylated such as by reaction with ethylene carbonate, propylene carbonate or butylene carbonate, for example as described in EP-A-2682451.

Lubricating Oil Composition

This, as indicated above, is an aspect of the invention.

The oil of lubricating viscosity (sometimes referred to as base oil or lubricating oil) provides a major proportion of the composition and may be any oil suitable for lubricating an internal combustion engine.

It may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These may be exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed C3-C8 fatty acid esters and C 13 oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment, are unrefined oils. Refined oils are similar to unrefined oils except that the oil is further treated in one or more purification steps to improve one or more properties. Many such purification techniques, such as distillation, solvent extraction, acid or base extraction, filtration and percolation, are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes groups of base stocks. As an example of an oil of lubricating viscosity that may be used in a lubricating oil composition of the present invention, there may be mentioned an oil containing 50 mass % or more of a basestock containing greater than or equal to 90% saturates and less than or equal to 0.03% sulphur or a mixture thereof. Preferably, it contains 60, such as 70, 80 or 90, mass % or more of said basestock or a mixture thereof. The oil of lubricating viscosity may consist or substantially consist of said basestock or a mixture thereof.

Oil of lubricating viscosity may provide 50 mass % or more of the composition. Preferably, it provides 60, such as 70, 80 or 90, mass % or more of the composition.

The composition may comprise, in addition to the detergent additive of the invention, one or more additive components, different from the additive of the invention, selected from one or more ashless dispersants, detergents, corrosion inhibitors, antioxidants, pour point depressants, antiwear agents, friction modifiers, demulsifiers, antifoaming agents and viscosity modifiers.

Engines

The detergent additives of the invention may be used in lubricants for a range of internal combustion engines (spark-ignited or compression ignited) such as motor vehicle engines and marine engines. Of the latter, there may be mentioned two-stroke marine diesel cross-head engines and marine trunk piston engines.

EXAMPLES

The present invention is illustrated by but in no way limited to the following examples.

Example 1

(A) Ca Phenate Detergents

Two detergents were made, each from TPP, one in a low TBN variant, and one in a high TBN variant. The following procedure was used:

- Tetrapropenylphenol, isodecanol (reaction solvent), ethylene glycol and an antifoam agent were charged to a reactor and heated to 50° C.
- This mixture was heated up to 90° C. during which, elemental sulphur and calcium oxide were charged to the mixture.
- Once at 90° C., further ethylene glycol and base oil were charged as required and the temperature increased to 115° C.
- $CO_2$ addition was started at 115° C. and added for between 6 and 8 hours as the temperature was raised to between 190 and 215° C.
- Once carbonation was complete, the reaction mixture was heated to, or held at, 210-215° C. and vacuum applied to remove reaction solvents and water.

(B) The high TBN Ca phenate (500 g) and isodecanol (IDA; 210.9 g) were added to a reactor flask (C) The product was subjected to the following heat-treatment regime

| Time (mins) | Temperature (° C.) |
|---|---|
| 30 | ambient-90 |
| 30 | 90-150 |
| 60 | 150-190 |
| 30 | 190-210 |

and then vacuum stripped at <30 mbar for 40 mins, compressed air cooled over 15 minutes and cooled overnight to ambient temperature.

Reference Example

The high TBN Ca phenate (200 g), without addition of IDA, was subject to an extensive sequence of heat treatment and vacuum distillation. Samples were taken after each of the first, second and third distillation treatments.

Results

| | % TPP (mass %) | Viscosity (KV100; $mm^2/s$) |
|---|---|---|
| Ca phenate Starting material | 14.6 | 265 |
| Example 1 | 5.3 | 592 |
| Reference Example | 3.4 | 4590 |

The results show that Example 1 (of the invention) reduced the % TPP of the Ca phenate starting material and also gave rise to a considerably lower viscosity product than the reference example.

Example 2

(A) The high TBN Ca phenate of Example 1 was used.

(B) and (C) IDA (10 mass %) was charged to the Ca phenate and the mixture subjected to the vacuum distillation treatment described in Example 1. The % TPP of the product was measured. The process step was repeated twice more, i.e. on each occasion, addition of 10% IDA, vacuum distillation and % TPP measurements were carried out. Thus, % TPP measurements were obtained for 0, 10, 20 and 30% IDA-charged products as set out below. They are the mass % content of C10, C11, C12+ alkylphenols determined by reverse phase high performance liquid chromatography (HPLC) using a UV detector.

Results

| IDA charge (total; mass %) | % TPP (mass %) |
|---|---|
| 0 | 14.66 |
| 10 | 8.46 |
| 20 | 7.12 |
| 30 | 5.65 |

The results show the benefits of multiple rounds of solvent addition and subsequent removal by distillation.

The invention claimed is:

1. A process for preparing a sulfurized calcium phenate detergent having a reduced content of unsulfurized alkyl-substituted phenol comprising the steps of:

(A) providing, made from an unsulfurized alkyl-substituted phenol, a sulfurized calcium phenate detergent that, optionally, may have been further reacted with carbon dioxide;

(B) adding to the detergent from 1 to 100 mass %, based on the mass of the detergent, of an organic solvent that has a boiling point of above 100° C. and below the boiling point of the unsulfurized alkyl-substituted phenol; and (C) distilling the solvent from the detergent thereby to reduce the content of the unsulfurized alkyl-substituted phenol.

2. The process of claim 1 where the organic solvent is an alkanol or an aromatic solvent.

3. The process of claim 1 where the organic solvent is isodecanol.

4. The process of claim 1 where the phenol is tetrapropenylphenol.

5. The process of claim 1 wherein, after step (B) and before step (C), base oil is added.

6. The process of claim 1 where steps (B) and (C) are carried out in a sequence of repeated steps.

7. The process of claim 1 where steps (B) and (C) are each carried out singly.

8. The process of claim 1 where phenolic functional groups in the product of step (C) are oxyalkylated.

9. The process of claim 8 where oxyalkylation is carried out by reaction with ethylene carbonate, propylene carbonate or butylene carbonate.

10. A sulfurized calcium phenate detergent obtained by the process of claim 1.

11. A lubricating oil composition comprising, or made by mixing, an oil of lubricating viscosity in a major amount and a detergent as claimed in claim 10.

12. The process of claim 1, wherein, in step (B), said organic solvent is added to said detergent in an amount of from 5 to 40 mass %, based on the mass of the detergent.

13. The process of claim 12, wherein said organic solvent is added to said detergent in an amount of from 5 to 30 mass %, based on the mass of the detergent.

* * * * *